US006771920B2

(12) United States Patent
Abe et al.

(10) Patent No.: US 6,771,920 B2
(45) Date of Patent: Aug. 3, 2004

(54) CHARGING ROLLER INCLUDING A CONDUCTIVE COVER LAYER BEING FORMED OF A SEAMLESS TUBE, PROCESS CARTRIDGE AND ELECTROPHOTOGRAPHIC IMAGE FORMING APPARATUS INCLUDING SUCH A CHARGING ROLLER

(75) Inventors: Hiroshi Abe, Ibaraki (JP); Akihiro Suzuki, Ibaraki (JP); Hirobumi Takahashi, Ibaraki (JP)

(73) Assignee: Canon Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/368,618

(22) Filed: Feb. 20, 2003

(65) Prior Publication Data

US 2003/0161664 A1 Aug. 28, 2003

(30) Foreign Application Priority Data

Feb. 21, 2002 (JP) ..... 2002-044861

(51) Int. Cl.[7] ..... G03G 15/02
(52) U.S. Cl. ..... 399/176
(58) Field of Search ..... 399/176, 175; 492/28, 36

(56) References Cited

U.S. PATENT DOCUMENTS

| | | | | |
|---|---|---|---|---|
| 4,851,960 A | | 7/1989 | Nakamura et al. | 361/225 |
| 4,967,231 A | | 10/1990 | Hosoya et al. | 355/219 |
| 5,089,851 A | | 2/1992 | Tanaka et al. | 355/219 |
| 5,608,500 A | * | 3/1997 | Funabashi et al. | 399/176 |
| 6,242,548 B1 | * | 6/2001 | Duchesne et al. | 526/255 |
| 6,470,162 B2 | * | 10/2002 | Abe et al. | 399/176 |

FOREIGN PATENT DOCUMENTS

| | | | |
|---|---|---|---|
| DE | 39 24 237 | * | 1/1990 |
| JP | 63-149669 | | 6/1988 |
| JP | 1-211779 | | 8/1989 |
| JP | 5-2313 A | | 1/1993 |
| JP | 5-96648 A | | 4/1993 |
| JP | 6-58325 A | | 3/1994 |
| JP | 10-228156 A | | 8/1998 |
| JP | 11-125952 | | 5/1999 |
| JP | 2000-6260 | * | 1/2000 |

* cited by examiner

*Primary Examiner*—Quana Grainger
(74) *Attorney, Agent, or Firm*—Fitzpatrick, Cella, Harper & Scinto

(57) ABSTRACT

In a charging roller having a support member and a conductive cover layer, the conductive cover layer is formed of a seamless tube. The seamless tube contains at least (A) a thermoplastic styrene elastomer, (B) a polystyrene resin and (C) a carbon black, and the proportion of the component (A) to the component (B) is (A)/(B)=60/40 to 20/80 in weight ratio. A process cartridge and an electrophotographic apparatus have such a charging roller.

8 Claims, 5 Drawing Sheets

CHARGING ROLLER INCLUDING A CONDUCTIVE COVER LAYER BEING FORMED OF A SEAMLESS TUBE, PROCESS CARTRIDGE AND ELECTROPHOTOGRAPHIC IMAGE FORMING APPARATUS INCLUDING SUCH A CHARGING ROLLER

BACKGROUND OF THE INVENTION

1. Field of the Invention

This invention relates to a charging roller, a process cartridge and an electrophotographic apparatus. More particularly, it relates to a charging roller which is a conductive member provided in contact with an electrophotographic photosensitive member and is used in a contact charging assembly which charges the electrophotographic photosensitive member electrostatically to a stated potential upon application of a voltage; and a process cartridge and an electrophotographic apparatus which make use of such a charging roller.

2. Related Background Art

A number of methods are conventionally known as methods for electrophotography. Copies are commonly obtained by forming an electrostatic latent image on an electrophotographic photosensitive member by utilizing a photoconductive material and by various means, subsequently developing the latent image by the use of a toner to form a visible image (a toner image), transferring the toner image to a transfer medium such as paper, and thereafter fixing the toner image to the transfer medium by heat and/or pressure. The toner not transferred to the transfer medium and remaining on the photosensitive member is also removed through a cleaning step from the surface of the photosensitive member.

As charging assemblies for electrophotography, corona charging assemblies have conventionally been used. In recent years, contact charging assemblies have been put into practical use in place of the former. This aims at low ozone and low power consumption. In particular, a roller charging system making use of a charging roller as a charging member is preferably used in view of the stability of charging.

In the roller charging, a conductive elastic roller is brought into pressure contact with a member to be charged (charging object) and a voltage is applied thereto to charge the charging object electrostatically.

Stated specifically, the charging is performed by causing electric discharge from the charging member to the charging object, and hence the charging takes place upon application of a voltage above a certain threshold voltage. For example, when a charging roller is brought into pressure contact with an organic electrophotographic photosensitive member having a 25 $\mu$m thick photosensitive layer and containing an organic photoconductive material (OPC electrophotographic photosensitive member), the surface potential of the electrophotographic photosensitive member begins to rise upon application of a voltage of about 640 V or above as absolute value and, at voltages above that voltage, the electrophotographic photosensitive member surface potential linearly increases at a gradient 1 with respect to the applied voltage. This threshold voltage is hereinafter defined as charging start voltage Vth.

That is, in order to attain an electrophotographic photosensitive member's surface potential Vd considered necessary for electrophotography, a DC voltage of Vd+Vth that is higher than is necessary must be applied to the charging roller. Such a method of applying only DC voltage to the contact charging member in this way is called DC charging.

In DC charging, however, it has been difficult to control the potential of the electrophotographic photosensitive member to the desired value, because any environmental variations may cause variations in electrical resistance of the contact charging member and also because any changes in layer thickness due to scrape of the electrophotographic photosensitive member surface may cause variations in the Vth.

Accordingly, in order to achieve more uniform charging, as disclosed in Japanese Patent Application Laid-open No. 63-149669, an AC+DC charging system is used in which a voltage formed by superimposing an AC component with a 2×Vth or higher peak-to-peak voltage on a DC component corresponding to the desired Vd. This is a system aiming at a potential-leveling effect which is attributable to AC, where the potential of the charging object converges to the Vd, the middle of the peak of AC voltage, and may hardly be affected by external disturbance such as environmental variations.

Meanwhile, as the conductive member for charging, U.S. Pat. No. 4,967,231 discloses an example in which using a conductive seamless tube a surface layer is formed on a conductive support member. Japanese Patent Application Laid-open No. 5-2313 also discloses a seamless tube comprised of a fluorine resin, and Japanese Patent Application Laid-open No. 5-96648 discloses a multi-layer tube comprised of layer construction having different conductivities. As a method concerning how to manufacture them as charging members, a method is available in which the tube is fitted onto the support member to form the surface layer. Japanese Patent Application Laid-open No. 6-58325 also discloses a method of forming the surface layer by means of a crosshead extruder.

Such methods of forming the charging roller by using the seamless tube enables formation of smooth surface even when a foam is used as an elastic layer formed on a substrate, because it may further be covered with the seamless tube. Thus, more uniform charging can be performed with ease.

However, where a seamless tube formed using a thermoplastic resin as a base is used, it has been difficult to provide a charging roller which can attain uniform charging performance and reproduced-image quality which are stable and good, because, e.g., changes in electrical resistance tend to occur for the expansion and contraction of roller caused by any changes in environment and changes with time, and any defects such as surface scratches tend to affect images.

SUMMARY OF THE INVENTION

An object of the present invention is to provide a charging roller which can make changes in electrical resistance small against the expansion and contraction of roller caused by any changes in environment and changes with time, and also can make it hard for any defects such as surface scratches to affect images and can promise uniform charging performance and reproduced-image quality which are stable and good.

Another object of the present invention is to provide a process cartridge and an electrophotographic apparatus which have such a charging roller.

That is, the present invention is a charging roller comprising a support member and a conductive cover layer;

the conductive cover layer being formed of a seamless tube, and the seamless tube containing at least the following components (A), (B) and (C):

(A) a thermoplastic styrene elastomer;

(B) a polystyrene resin; and (C) a carbon black;

and the proportion of the component (A) to the component (B) being (A)/(B)=60/40 to 20/80 in weight ratio.

The present invention is also a process cartridge and an electrophotographic apparatus which have the above charging roller.

DESCRIPTION OF THE PREFERRED EMBODIMENTS

Figure 1:
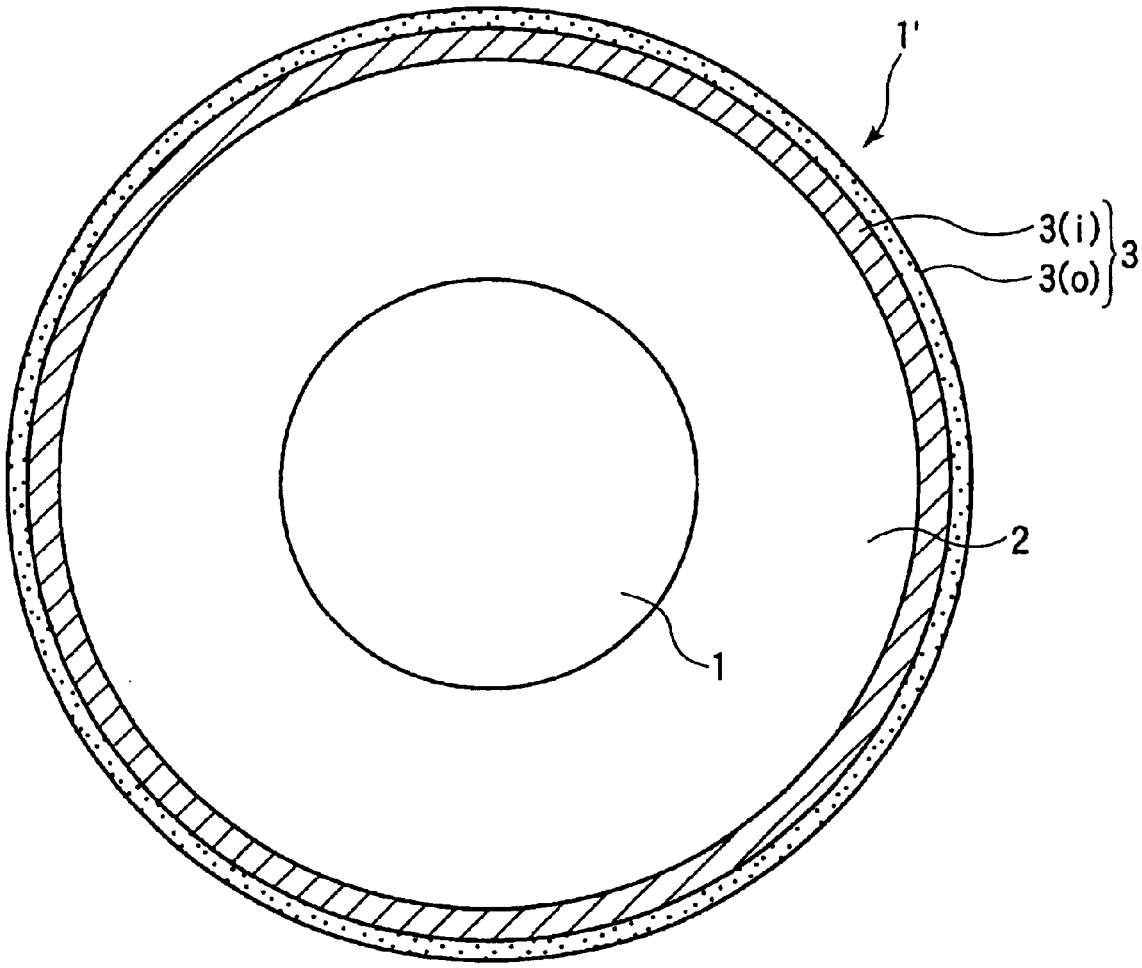
FIG. 1 illustrates an example of the construction of the charging roller of the present invention.

The charging roller of the present invention has a support member and a conductive cover layer.

The conductive cover layer the charging roller of the present invention has is formed of a seamless tube, and the seamless tube contains at least the following components (A), (B) and (C):

(A) a thermoplastic styrene elastomer;

(B) a polystyrene resin; and (C) a carbon black;

and the ratio of the component (A) to the component (B) is (A)/(B)=60/40 to 20/80.

The component-(A) thermoplastic styrene elastomer is a block copolymer or terpolymer having a hard segment constituted of polystyrene (a polymer of styrene) and a soft segment constituted of any of butadiene, propylene and hydrogenated products of these. As preferred examples, it may include poly(styrene-hydrogenated butadiene-crystal olefin) block terpolymer (SEBC), poly(styrene-hydrogenated butadiene-styrene) block terpolymer (SEBS), poly(styrene-butadiene-styrene) block terpolymer (SBS), poly(styrene-hydrogenated isoprene-styrene) block terpolymer (SEPS) and poly(styrene-vinylisoprene-styrene) block terpolymer. Of these, SEBC, SEBS and SEPS, in which the soft segment has been hydrogenated, are particularly preferred.

As preferred examples of the component-(B) polystyrene resin, it may include general-purpose polystyrene (GPPS) and impact-resistant polystyrene (HIPS).

As the proportion of the component (A) to the component (B), it is (A)/(B)=60/40 to 20/80 in weight ratio, and may preferably be 60/40 to 40/60. If the component (A) is less than 20/80 in the proportion of the component (A) to the component (B), the tube may come so hard and have so poor elasticity as to bring about a problem that the tube can not be put over the support member to cover it or, even if it can be done, the roller may have poor shape to make it difficult to be usable as the charging roller. If on the other hand the component (A) is more than 60/40 in the proportion of the component (A) to the component (B), the value of electric current (electrical resistance) may greatly vary for the expansion and contraction (of tube), resulting in a poor resistance to scratches as well.

In the present invention, as the constitution of base resins of the seamless tube, the thermoplastic styrene elastomer and the polystyrene resin are blended in the specific proportion to make the tube have a microscopically phase-separated structure. This can make the surface have a higher hardness without damaging the elasticity of the relatively soft, styrene elastomer (so far as about 75° as Shore-A hardness), and hence the tube can be very strong against scratching, as so considered. In addition, since it stands microscopically phase-separated, only the elastomer phase stretches when the tube is stretched, and the polystyrene resin phase does not. Hence, changes in the value of electric current (electrical resistance) can also be made small against the expansion and contraction of the seamless tube. Then, it is considered that the cooperative effect of being not easily scratchable and being not easily changeable in electrical resistance has made it hard for any changes of tube such as scratching to affect images. Thus, a remarkable effect as in the present invention can not be seen by merely making styrene content higher in the styrene elastomer to improve hardness.

In the present invention, the component (A) and the component (B) may also preferably be in a total content of from 40% by weight to 90% by weight, and particularly preferably from 60% by weight to 80% by weight, based on the total weight of the solid matter of the seamless tube.

As a method of providing the seamless tube with conductivity, it may commonly include a method of ionic conduction which uses a salt as a conducting agent and a method of electronic conduction which uses carbon black, a conductive metal oxide, a metal powder or the like as a conducting agent. In the case of providing the tube with conductivity by ionic conduction, there are problems that environmental variations of electrical resistance tend to occur greatly and also that, since the tube comes into contact with the electrophotographic photosensitive member, the salt tends to contaminate the electrophotographic photosensitive member. Accordingly, in the present invention, the carbon black is used as the conducting agent [component (C)].

As preferred examples of the component-(C) carbon black, it may include, e.g., as commercially available products, KETJEN BLACK (available from Lion Akzo Co., Ltd.); PRINTEX, SPECIAL BLACK and COLOR BLACK (all available from Degussa Japan Ltd.); BLACK PEARLS (available from Cabot Corporation); ASAHI CARBON (available from Asahi Carbon Co., Ltd.); MITSUBISHI CARBON (available from Mitsubishi Carbon Co., Ltd.); DENKA BLACK (available from Denki Kagaku Kogyo Kabushiki Kaisha); SEAST and TOKA BLACK (all available from Tokai Carbon Co., Ltd.).

The component-(C) carbon black may be any type of carbon black as long as it can make the conductive cover layer have an electrical resistance of from $1\times10^{6}$ Ω·cm to $1\times10^{11}$ Ω·cm and satisfies the above content. Two or more types of carbon black may also be used in the form of a mixture. In the present invention, it is preferable to use in the form of a mixture a carbon black showing a high conductivity and a carbon black showing a low conductivity.

The component-(C) carbon black may be used in a proportion of from 10% by weight to 60% by weight, and more preferably from 20% by weight to 40% by weight, based on the total weight of the solid matter of the seamless tube. If the component-(C) carbon black is in a proportion of less than 10% by weight, the electrical resistance at the time the charging roller is used under electrification may greatly rise to tend to cause a problem that the charging roller has poor durability. If on the other hand the component-(C) carbon black is in a proportion of more than 60% by weight, the tube may come so hard and have so poor elasticity as to make it hard for the tube to be put over the support member to cover it.

In the present invention, additives other than the foregoing may optionally be used. Such additives may include conductive filler, an antioxidant, a softening agent, a plasticizer, a reinforcing agent and a filler. The conductive filler may include graphite and metal oxides. The metal oxides may include, e.g., titanium oxide and zinc oxide.

The seamless tube used to form the conductive cover layer of the present invention may be obtained by kneading the thermoplastic styrene elastomer, the polystyrene resin and the carbon black together with any optional additives, subsequently pelletizing the kneaded product, and extruding the resultant pellets into a cylindrical tube by means of an extruder. Then, the seamless tube having been forming-worked is put over the support member to cover it, to make up a conductive member which is the charging roller.

To cover the support member with the seamless tube, a means may be employed in which the seamless tube is formed to have an inner diameter larger than the outer diameter of the support member to be covered and then the tube is made to contract by a physical or chemical means, e.g., by heat, or in which the seamless tube is formed to have an inner diameter smaller than the outer diameter of the support member to be covered and then the tube is stretched out and fitted to the support member by a physical or chemical means, e.g., by air pressure. Examples thereof are disclosed in, e.g., Japanese Patent Application Laid-open No. 10-228156. The present invention can attain a seamless tube favorable for the manufacture described above, and consequently can provide a conductive member having very good characteristics.

There are no particular limitations on the thickness of the seamless tube in the present invention, which may preferably be in a thickness of from 100 $\mu$m to 600 $\mu$m. The thickness of the seamless tube does not greatly change before and after the covering with the tube. Hence, this thickness of the seamless tube may be employed also as the thickness of the conductive cover layer. In the present invention, the seamless tube may also be formed as a multi-layer simultaneous extrusion tube as disclosed in Japanese Patent Application Laid-open No. 11-125952. In the case of such a multi-layer simultaneous extrusion tube, the seamless tube may have a layer or layers which does or do not satisfy the constitution of the present invention. However, in the present invention, at least the surface layer must satisfy the constitution of the conductive cover layer of the present invention.

The support member used in the present invention may include an elastic roller comprised of a conductive substrate and an elastic layer provided thereon.

There are no particular limitations on materials for the conductive substrate. For example, as disclosed in Japanese Patent Application Laid-open No. 1-211799, metals such as iron, copper and stainless steel, carbon-dispersed resins, and metal- or metal-oxide-dispersed resins may be used as materials for the conductive substrate. It may have the shape of a rod or a plate. As the elastic layer, any of rubbers such as chloroprene rubber, isoprene rubber, EPDM rubber, polyurethane rubber, epoxy rubber and butyl rubber, or sponge, and thermoplastic resins such as styrene-butadiene, polyurethane, polyester and ethylene-vinyl acetate may be used to form it. These rubbers or resins may be incorporated with a conducting agent such as carbon black or metal or metal oxide particles.

In the present invention, a conducting layer or a resistance layer may further be formed on the elastic layer.

As the conducting layer, any of, e.g., a metal vacuum-deposited film, a conductive-particle-dispersed resin and a conductive resin may be used. As specific examples of the metal vacuum-deposited film, it may include vacuum-deposited films of aluminum, indium, nickel, copper and iron. As specific examples of the conductive-particles-dispersed resin, it may include resins such as urethane, polyester, vinyl acetate-vinyl chloride copolymer and polymethyl methacrylate in which conductive particles of any of carbon, aluminum, nickel, titanium oxide and the like have been dispersed. The conductive resin may include quaternary-ammonium-salt-containing polymethyl methacrylate, polyvinyl aniline, polyvinyl pyrrole, polydiacetylene and polyethylene imine.

As the resistance layer, a conductive resin and a conductive-particles-dispersed insulating resin may be used. The conductive resin may include resins such as ethyl cellulose, nitro cellulose, methoxymethylated polyamide, ethoxymethylated polyamide, copolymer polyamide, polyvinyl hydrin and casein. As examples of the conductive-particles-dispersed insulating resin, it may include insulating resins such as urethane, polyester, vinyl acetate-vinyl chloride copolymer and polymethyl methacrylate in which conductive particles of any of carbon, aluminum, indium oxide, titanium oxide and the like have been dispersed.

As the charging roller, the one having the support member and the seamless tube, constituted according to the present invention, has superior manufacturing stability, and those of medium-resistance region which have ever been considered difficult to produce stably can stably be produced.

An example of the construction of the charging roller is shown in FIG. 1 by reference numeral 1'. In FIG. 1, reference numeral 1 denotes the conductive substrate; 2, the elastic layer; 3, a cover layer; 3(*i*), the conducting layer; and 3(*o*), the conductive cover layer of the present invention. In this case, the conductive substrate 1, the elastic layer 2 and the conducting layer 3(*i*) are inclusively called the support member.

There are no particular limitations on the electrophotographic photosensitive member, an exposure means, a developing means, a transfer means and a cleaning means which are used in the present invention.

Figure 2:
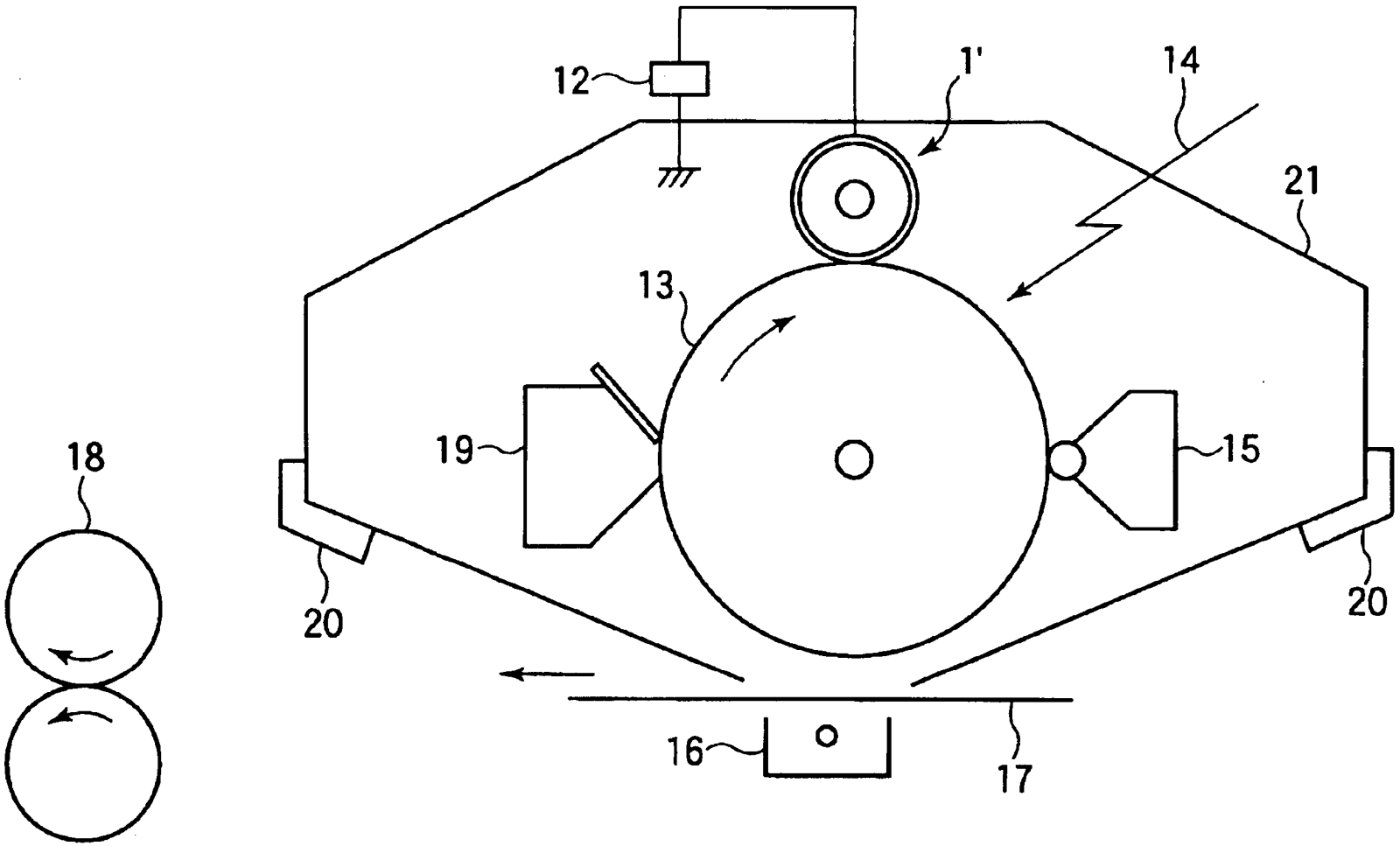
FIG. 2 schematically illustrates the construction of an electrophotographic apparatus provided with a process cartridge having the charging roller of the present invention as a primary charging means.

FIG. 2 shows an example of the construction of an electrophotographic apparatus having a process cartridge having the charging roller of the present invention as a primary charging means.

In FIG. 2, reference numeral 13 denotes an electrophotographic photosensitive member, which is rotatingly driven in the direction of an arrow at a stated peripheral speed. The electrophotographic photosensitive member 13 is, in the course of its rotation, uniformly electrostatically charged on its periphery to a positive or negative, given potential through the charging roller 1' of the present invention as a primary charging means, and then exposed to exposure light 14 emitted from an exposure means (not shown) for slit exposure or laser beam scanning exposure. In this way, electrostatic latent images are successively formed on the periphery of the electrophotographic photosensitive member 13.

The electrostatic latent images thus formed are subsequently developed with toner by the operation of a developing means 15. The resulting toner-developed images are then successively transferred by the operation of a transfer means 16, to a transfer medium 17 fed from a paper feed section (not shown) to the part between the electrophotographic photosensitive member 13 and the transfer means 17 in the manner synchronized with the rotation of the electrophotographic photosensitive member 13.

The transfer medium 17 to which the images have been transferred is separated from the surface of the electrophotographic photosensitive member, is guided into a fixing means 24, where the images are fixed, and is then printed out of the apparatus as a copied material (a copy).

The surface of the electrophotographic photosensitive member 13 from which images have been transferred is brought to the removal of the toner remaining after the transfer, through a cleaning means 19. Thus the electrophotographic photosensitive member is cleaned on its surface, and then repeatedly used for the formation of images.

In the present invention, the apparatus may be constituted of a combination of plural components held in a container and integrally joined as a process cartridge from among the constituents such as the above electrophotographic photosensitive member 13, conductive member (charging roller) 1', developing means 15 and cleaning means 19 so that the process cartridge is detachably mountable to the body of the electrophotographic apparatus such as a copying machine or a laser beam printer. For example, at least one of the developing means 15 and the cleaning means 19 may integrally be supported in a cartridge together with the electrophotographic photosensitive member 13 and the conductive member 1', to form a process cartridge 21 that is detachably mountable to the main body of the apparatus through a guide means 20 such as rails provided in the main body of the apparatus.

The present invention is described below in greater detail by giving working examples specifically. In these working examples, double-layer simultaneous extrusion tubes are produced in the following way.

Figure 3:
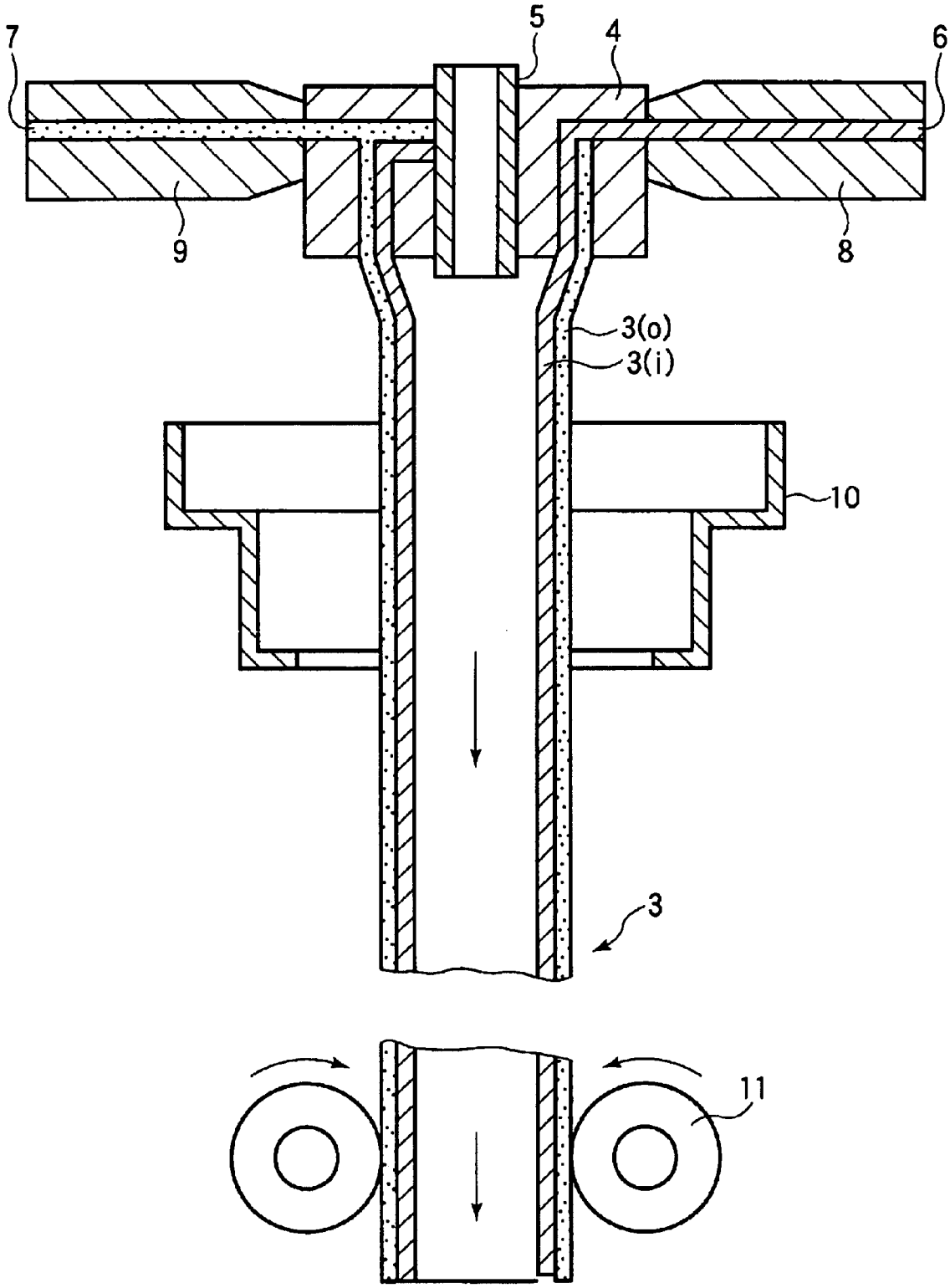
FIG. 3 schematically illustrates the construction of an apparatus for manufacturing the charging roller of the present invention, constituted of a seamless tube.

As shown in FIG. 3, a die 4 used in extrusion is provided with inner and outer double circular extrusion channels 6 and 7 around an air-introducing center through-hole 5. At the time of extrusion, an inner-layer extrusion material and an outer-layer extrusion material are poured under pressure into the inside channel 6 and the outside channel 8 from a first extruder 8 and a second extruder 9, respectively, and are extruded in such a way that an inner layer 3(*i*) and an outer layer 3(*o*) are superposed in an integral form to obtain a double-layer simultaneous extrusion tube 3, which is then cooled through a water-cooling ring 10 provided along the periphery of the tube 3, and this is stretched by means of a tube lead-on assembly 11. The tube is then successively cut in a stated length. In the next step, the tube thus cut is, as the seamless tube for the charging roller, put over a foamed elastic layer (the elastic layer 2) provided on the conductive substrate (mandrel) 1.

Thus, a tube of double-layer film having a thin-gage layer which has been difficult to cover alone as a tube can also be produced with ease by forming the seamless tube 3 by multi-layer simultaneous extrusion.

The seamless tube thus obtained is put over the foamed elastic layer to cover it, to make up the charging roller 1' like that shown in FIG. 1. The inner layer is a low-resistance conducting layer, and the outer layer constitutes the tube corresponding to that of the present invention. In the following working examples, "part(s)" refers to "part(s) by weight".

Seamless Tube

Production Examples 1–1 to 1-6

As materials for the outer-layer tube, SEBC (styrene content: 20%) and GPPS were blended in a proportion of SEBC/GPPS=0/100, 20/80, 40/60, 60/40, 80/20 or 100/0 parts, to each of which 5 parts of KETJEN BLACK EC, 20 parts of SPECIAL BLACK 250, 10 parts of magnesium oxide and 1 part of calcium stearate were added. These were kneaded at 180° C. for 15 minutes by means of a pressure kneader. The kneaded product obtained was cooled and then pulverized, and thereafter the pulverized product was pelletized by means of an extruder for granulation. Here, one in which SEBC/GPPS was in the proportion of 0/100 was designated as sample No. 1-1; and the rest 20/80 as No. 1-2, 40/60 as No. 1-3, 60/40 as No. 1-4, 80/20 as No. 1-5, and 100/0 as No. 1-6. The sample Nos. 1-2 to 1-4 are within the scope of the present invention. The sample Nos. 1-1, 1–5 and 1-6 are outside the scope of the present invention.

As materials for the inner-layer tube, to 100 parts of thermoplastic polyurethane elastomer (TPU), 16 parts of KETJEN BLACK EC, 10 parts of magnesium oxide and 1 part of calcium stearate were added. These were kneaded at 180° C. for 15 minutes by means of a pressure kneader. The kneaded product obtained was cooled and then pulverized, and thereafter the pulverized product was pelletized by means of an extruder for granulation.

The above pellets for the respective layers were extruded by means of a double-layer extruder having a die of 16.5 mm in inner diameter and a point of 18.5 mm in outer diameter, followed by sizing and cooling, through the steps of which the extruded products were forming-worked into seamless tubes Nos. 1-1 to 1-6 each having an inner diameter of 11.1 mm, an outer-layer thickness of 100 $\mu$m and an inner-layer thickness of 400 $\mu$m.

Changes in electrical resistance for the elongation of the seamless tubes Nos. 1-1 to 1-6 thus obtained were examined in the following way to make evaluation.

First, the seamless tubes Nos. 1-1 to 1-6 thus forming-worked were each prepared in plurality, and these were put over stainless-steel rods having different diameters (diameters: 11.2, 11.4, 11.6, 11.8 and 12.0 mm), to cover them respectively, which were then left for 24 hours in an environment of temperature 15° C. and humidity 55%. These tubes Nos. 1-1 to 1-6 came in elongations of 0.9% on the 11.2 mm diameter rod, 2.7% on the 11.4 mm diameter rod, 4.5% on the 11.6 mm diameter rod, 6.3% on the 11.8 mm diameter rod, and 8.1% on the 12.0 mm diameter rod. Thereafter, the rollers thus obtained by covering with these tubes the stainless-steel rods having different diameters were each brought into contact with a stainless-steel drum (diameter: 30 mm). The stainless-steel drum was rotated at 30 rpm and a DC voltage of 200 V was applied, where the value of electric current was measured to find the electrical resistance.

Figure 4:
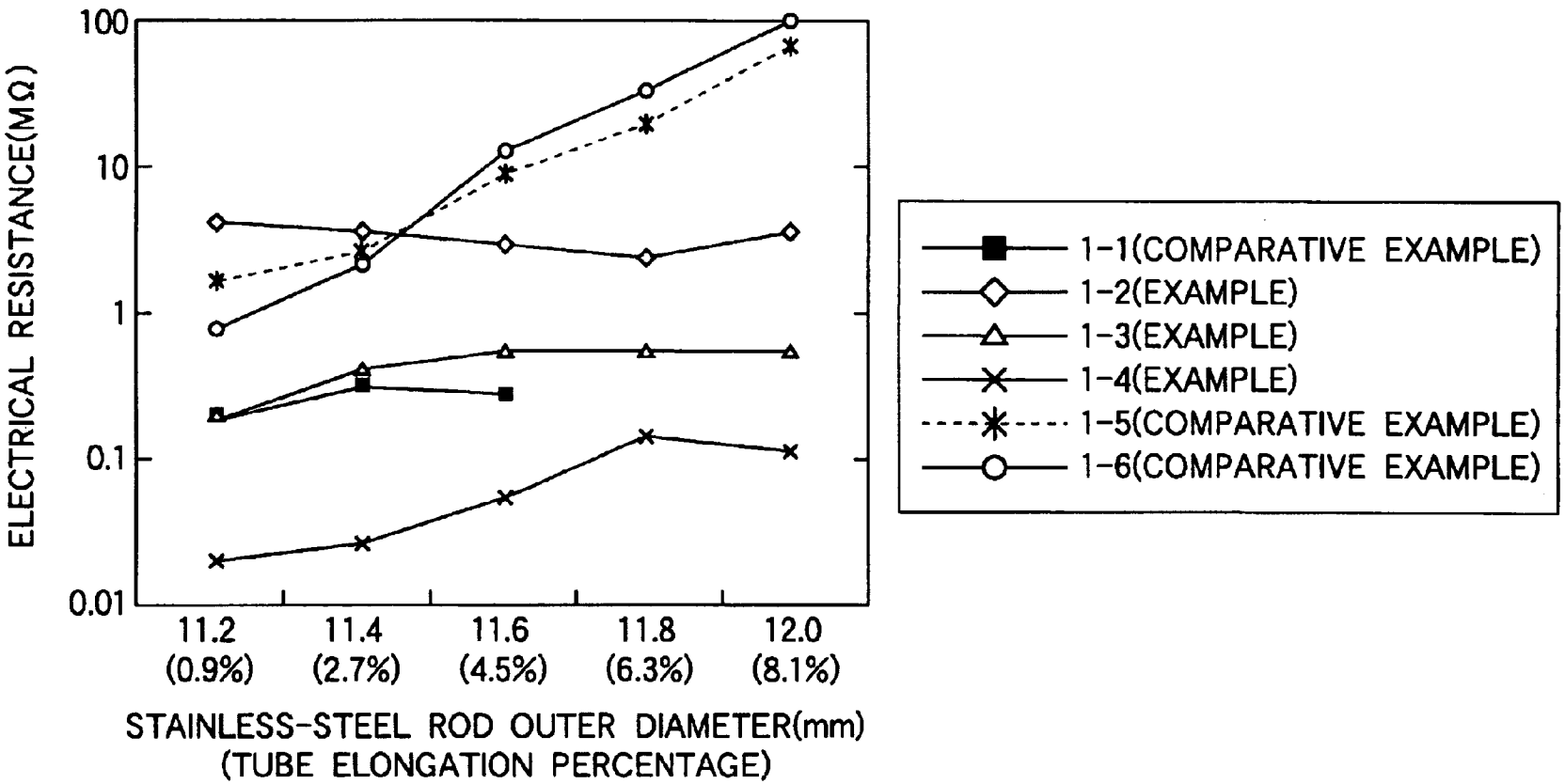
FIG. 4 is a graph showing the results of measuring changes in electrical resistance with respect to the elongation of seamless tubes 1-1 to 1-6.

The results are shown in FIG. 4. The ratio of the value of electrical resistance measured on the 11.2 mm diameter stainless-steel rod roller to the value of electrical resistance measured on the 12.0 mm diameter stainless-steel rod roller are also shown in Table 1. Incidentally, in respect of the ones on the sample No. 1-1 stainless-steel rods of 11.2 mm or more in diameter, the tube was too hard to be put over the rods to cover them.

Seamless Tube

Production Examples 2–1 to 2-3

As materials for the outer-layer tube, 40 parts of SEBC (styrene content: 20%) and 60 parts of HIPS were blended, and 5 parts of KETJEN BLACK, 20 parts of SPECIAL BLACK 250, 10 parts of magnesium oxide and 1 part of calcium stearate were added thereto. These were kneaded at 180° C. for 15 minutes by means of a pressure kneader. The kneaded product obtained was cooled and then pulverized, and thereafter the pulverized product was pelletized by means of an extruder for granulation (sample No. 2-1). Thereafter, through the same production steps as those in Seamless Tube Production Examples 1–1 to 1-6, extrusion and forming were carried out to obtain a seamless tube No. 2-1 having an inner diameter of 11.1 mm, an outer-layer thickness of 100 $\mu$m and an inner-layer thickness of 400 $\mu$m.

For comparison, those in which low-density polyethylene (LDPE) and high-density polyethylene (HDPE) were each blended in place of the HDPE were also kneaded and then pelletized (samples Nos. 2-2 and 2-3, respectively), followed by extrusion to obtain seamless tubes Nos. 2-2 and 2-3 in the same way.

Changes in electrical resistance for the elongation of the seamless tubes Nos. 2-1 to 2-3 thus obtained were examined in the same manner as in Seamless Tube Production Examples 1–1 to 1-6 to make evaluation.

Figure 5:
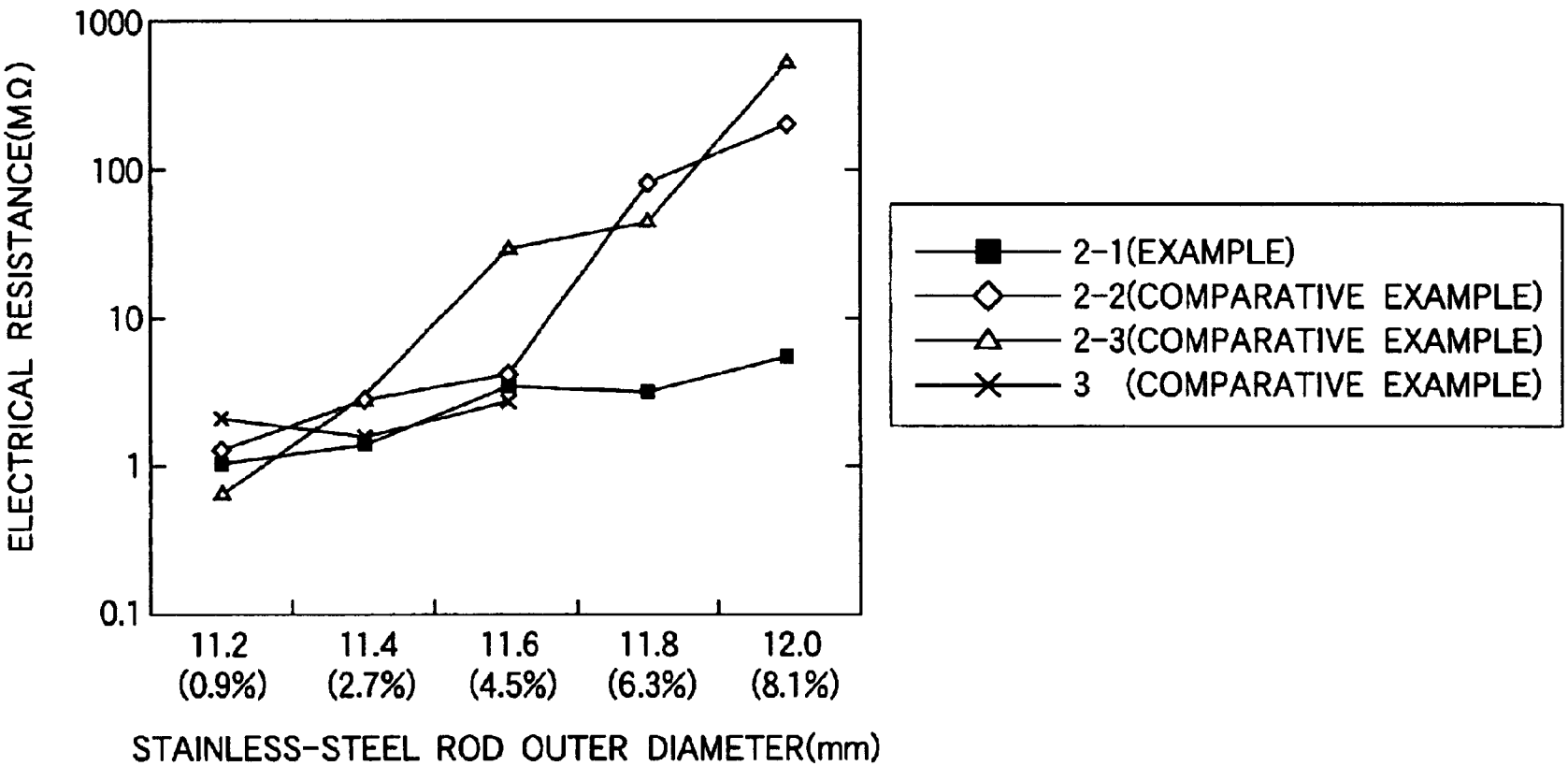
FIG. 5 is a graph showing the results of measuring changes in electrical resistance with respect to the elongation of seamless tubes 2-1 to 2-3 and 3.

The results are shown in FIG. 5 and Table 1.

Seamless Tube

Production Examples 3

As materials for the outer-layer tube, to 100 parts of SEBS (styrene content: 65%), 5 parts of KETJEN BLACK, 20 parts of SPECIAL BLACK 250, 10 parts of magnesium oxide and 1 part of calcium stearate were added thereto. These were kneaded at 180° C. for 15 minutes by means of a pressure kneader. The kneaded product obtained was cooled and then pulverized, and thereafter the pulverized product was pelletized by means of an extruder for granulation (sample No. 3). Thereafter, through the same production steps as those in Seamless Tube Production Examples 1–1 to 1-6, extrusion and forming were carried out to obtain a seamless tube No. 3 having an inner diameter of 11.1 mm, an outer-layer thickness of 100 $\mu$m and an inner-layer thickness of 400 $\mu$m.

Changes in electrical resistance for the elongation of the seamless tube No. 3 thus obtained were attempted to examine in the same manner as in Seamless Tube Production Examples 1–1 to 1-6 to make evaluation. However, like the seamless tube No. 1-1, in respect of the ones on the stainless-steel rods of 11.2 mm or more in diameter, the tube was too hard to be put over the rods to cover them.

TABLE 1

| Seamless tube No.: | 1-2 (Ex) | 1-3 (Ex) | 1-4 (Ex) | 1-5 (Cp) | 1-6 (Cp) | 2-1 (Ex) | 2-2 (Cp) | 2-3 (Cp) |
|---|---|---|---|---|---|---|---|---|
| Electrical resistance ratio of 12.0/11.2 mm diameter rod rollers: | 0.82 | 2.9 | 5.5 | 38 | 130 | 5.2 | 150 | 710 |

Ex: Example;
Cp: Comparative Example

As can be seen from FIGS. 4 and 5 and Table 1, when the proportion of thermoplastic styrene elastomer/polystyrene resin is from 60/40 to 20/80, the changes in electrical resistance are differentially small against the elongation of the seamless tube and are restrained within 10 times.

Examples & Comparative Examples

The seamless tubes obtained in the above respective Production Examples were each put over the periphery of a foamed elastic layer to cover it; the foamed elastic layer being comprised of a conductive elastic material and provided on a stainless-steel rod of 6.0 mm in diameter. Thus, charging rollers having the same layer construction as the one shown in FIG. 1 were produced. Here, their conductive cover layers were each in a thickness of 100 $\mu$m for the outer layer and 400 $\mu$m for the inner layer.

To evaluate scratch resistance, #1000 sandpaper was pressed against the charging roller surface at a constant load and the roller was rotated to scratch its surface. The charging roller thus scratched was set in the process cartridge having the construction shown in FIG. 2, and halftone images were reproduced to make evaluation by visually observing whether or not any faulty images due to scratches appeared. The results are shown in Tables 2 and 3. In Tables 2 and 3, "A" shows that faulty images due to scratches were little seen on images, "B" shows that faulty images due to scratches were slightly seen on images, and "C" shows that faulty images due to scratches appeared clearly.

TABLE 2

| | 1-1 (Cp) | 1-2 (Ex) | 1-3 (Ex) | 1-4 (Ex) | 1-5 (Cp) | 1-6 (Cp) |
|---|---|---|---|---|---|---|
| Component (A) Styrene elastomer: | | | | | | |
| Type | — | SEBC | SEBC | SEBC | SEBC | SEBC |
| (pbw) | 0 | 20 | 40 | 60 | 80 | 100 |
| Component (B) Polystyrene resin: | | | | | | |
| Type | GPPS | GPPS | GPPS | GPPS | GPPS | — |
| (pbw) | 100 | 80 | 60 | 40 | 20 | 0 |
| (A)/(B) | 0/100 | 20/80 | 40/60 | 60/40 | 80/20 | 100/0 |
| Sandpaper scratching under pressure of: | | | | | | |
| (500 g/cm$^2$) | * | A | A | A | C | C |
| (1,500 g/cm$^2$) | * | A | A | B | C | C |

Ex: Example;
Cp: Comparative Example
*Uncoverable with tube.

TABLE 3

| | 2-1 (Ex) | 2-2 (Cp) | 2-3 (Cp) | 3 (Cp) |
|---|---|---|---|---|
| Component (A) Styrene elastomer: | | | | |
| Type | SEBC | SEBC | SEBC | SEBC*1 |
| (pbw) | 40 | 40 | 40 | 100 |
| Component (B) Polystyrene resin (or its substitute): | | | | |
| Type | HIPS | LDPE | HDPE | — |
| (pbw) | 60 | 60 | 60 | 0 |
| (A)/(B) | 40/60 | 40/60 | 40/60 | 100/0 |

TABLE 3-continued

| | 2-1 (Ex) | 2-2 (Cp) | 2-3 (Cp) | 3 (Cp) |
|---|---|---|---|---|
| Sandpaper scratching under pressure of: | | | | |
| (500 g/cm$^2$) | A | C | C | C |
| (1,500 g/cm$^2$) | A | C | C | C |

Ex: Example;
Cp: Comparative Example
*1 high styrene content

As can be seen from the above results, the electrical resistance becomes stabilized against the elongation of tube with an increase in the content of the polystyrene resin, and correspondingly therewith the scratch resistance becomes improved to cause faulty images due to scratches with more difficulty. However, when the content of the polystyrene resin is larger than 20/80 in the proportion of thermoplastic styrene elastomer/polystyrene resin, it is difficult for the tube to be put over the foamed elastic layer to cover it, and the charging roller has a poor shape if the tube is too much stretched when put over the support member.

Thus, the incorporation of the two resin components, the thermoplastic styrene elastomer and the polystyrene resin, and the carbon black as a conducting agent has made it possible to provide a charging roller which can make changes in electrical resistance small against the expansion and contraction of roller caused by any changes in environment and changes with time, and also can make it hard for any defects such as surface scratches to affect images and can promise uniform charging performance and reproduced-image quality which are stable and good, and to provide a process cartridge and an electrophotographic apparatus which have such a charging roller.

What is claimed is:

1. A charging roller comprising:

a support member; and a conductive cover layer, said conductive cover layer being formed of a seamless tube, and said seamless tube containing at least the following components (A), (B) and (C):

(A) a thermoplastic styrene elastomer;

(B) a polystyrene resin; and (C) a carbon black;

and wherein the weight ratio of the component (A) to the component (B) is (A)/(B)=60/40 to 20/80.

2. A charging roller according to claim 1, wherein the weight ratio of the component (A) to the component (B) is (A)/(B)=60/40 to 40/80.

3. A charging roller according to claim 1, wherein said conductive cover layer has an electrical resistance of from $1\times10^6$ Ω.cm to $1\times10^{11}$ Ω.cm.

4. A charging roller according to claim 1, wherein said seamless tube is a tube obtained by extruding extrusion materials simultaneously into a plurality of layers.

5. A charging roller according to claim 1, wherein said conductive cover layer is a surface layer.

6. A charging roller according to claim 1, wherein said support member comprises a conductive substrate and an elastic layer provided thereon.

7. A process cartridge comprising:

an electrophotographic photosensitive member; and a charging roller which is provided in contact with said electrophotographic photosensitive member and charges said electrophotographic photosensitive member electrostatically upon application of a voltage, said charging roller comprising:

a support member; and a conductive cover layer, said electrophotographic photosensitive member and said charging roller being supported as one unit that is detachably mountable to a main body of an electrophotographic apparatus as the process cartridge, said conductive cover layer being formed of a seamless tube, and said seamless tube containing at least the following components (A), (B) and (C):

(A) a thermoplastic styrene elastomer;

(B) a polystyrene resin; and (C) a carbon black;

and wherein the weight ratio of the component (A) to the component (B) is (A)/(B)=60/40 to 20/80.

8. An electrophotographic apparatus comprising:

an electrophotographic photosensitive member; and a charging roller that is provided in contact with said electrophotographic photosensitive member and charges said electrophotographic photosensitive member electrostatically upon application of a voltage, said charging roller comprising:

a support member; and a conductive cover layer, said conductive cover layer being formed of a seamless tube, and said seamless tube containing at least the following components (A), (B) and (C):

(A) a thermoplastic styrene elastomer;

(B) a polystyrene resin; and (C) a carbon black;

and wherein the weight ratio of the component (A) to the component (B) is (A)/(B)=60/40 to 20/80.

* * * * *

UNITED STATES PATENT AND TRADEMARK OFFICE

CERTIFICATE OF CORRECTION

PATENT NO. : 6,771,920 B2
DATED : August 3, 2004
INVENTOR(S) : Hiroshi Abe et al.

It is certified that error appears in the above-identified patent and that said Letters Patent is hereby corrected as shown below:

Column 5,
Line 26, “forming-” should read -- formed- --.

Column 8,
Line 35, “forming-worked” should read -- formed-worked --.
Line 42, “forming-” should read -- formed- --.

Signed and Sealed this

Fifteenth Day of February, 2005

JON W. DUDAS
*Director of the United States Patent and Trademark Office*